US009394066B2

(12) United States Patent
Hengami

(10) Patent No.: US 9,394,066 B2
(45) Date of Patent: Jul. 19, 2016

(54) SLIDE OPENING BOX WITH INTEGRAL LINER

(71) Applicant: David Todjar Hengami, Torrance, CA (US)

(72) Inventor: David Todjar Hengami, Torrance, CA (US)

( * ) Notice: Subject to any disclaimer, the term of this patent is extended or adjusted under 35 U.S.C. 154(b) by 0 days.

(21) Appl. No.: 14/339,408

(22) Filed: Jul. 23, 2014

(65) Prior Publication Data

US 2014/0331615 A1 Nov. 13, 2014

Related U.S. Application Data

(63) Continuation of application No. 13/175,779, filed on Jul. 1, 2011, now abandoned.

(51) Int. Cl.

| | |
|---|---|
| ***B65B 1/02*** | (2006.01) |
| ***B65D 1/06*** | (2006.01) |
| ***B65B 43/08*** | (2006.01) |
| ***B65D 5/72*** | (2006.01) |
| ***B65D 5/60*** | (2006.01) |
| ***B65B 1/06*** | (2006.01) |
| ***B65B 7/20*** | (2006.01) |
| ***B65B 69/00*** | (2006.01) |

(52) U.S. Cl.

CPC ... *B65B 1/02* (2013.01); *B65B 1/06* (2013.01); *B65B 7/20* (2013.01); *B65B 43/08* (2013.01); *B65B 69/0008* (2013.01); *B65D 5/603* (2013.01); *B65D 5/723* (2013.01); *B31B 2217/0076* (2013.01)

(58) Field of Classification Search

CPC ..... B31B 2217/0076

See application file for complete search history.

(56) References Cited

U.S. PATENT DOCUMENTS

| | | | | |
|---|---|---|---|---|
| 3,071,304 | A | 1/1963 | Brastad | |
| 3,136,471 | A | 6/1964 | Brastad | |
| 5,197,625 | A * | 3/1993 | Mullaney | B65D 5/541 229/117.3 |
| 5,918,799 | A * | 7/1999 | Walsh | B65D 5/56 229/117.33 |
| 6,227,440 | B1 * | 5/2001 | Hart | B65D 5/744 229/117.3 |
| 6,273,332 | B1 | 8/2001 | Hengami | |
| 6,474,040 | B1 * | 11/2002 | Ours | B65B 61/186 229/117.3 |
| 6,637,646 | B1 * | 10/2003 | Muise | B31B 7/00 229/117.01 |
| 6,889,892 | B2 * | 5/2005 | Walsh | B65D 5/744 229/117.3 |
| 7,040,528 | B2 | 5/2006 | Hengami | |
| 7,156,286 | B2 | 1/2007 | Hengami | |
| 7,494,044 | B2 * | 2/2009 | Walsh | B65D 5/4266 229/117.32 |
| 8,261,964 | B2 * | 9/2012 | Raupach | B65D 77/065 221/302 |
| 8,800,855 | B2 * | 8/2014 | Fitzwater | B65D 5/0227 229/129.1 |
| 2004/0004111 | A1 | 1/2004 | Cardinale | |
| 2004/0065723 | A1 | 4/2004 | Hengami | |
| 2011/0117258 | A1 | 5/2011 | Burke | |
| 2013/0001284 | A1 | 1/2013 | Hengami | |

* cited by examiner

*Primary Examiner* — Gary Elkins

(74) *Attorney, Agent, or Firm* — Robert J. Lauson; Lauson & Tarver LLP

(57) ABSTRACT

A box with a sliding opening has an integral liner to keep pourable contents fresh and dry. The box has a slide that is moveable by a user's thumb across the opening to open and close the box and the liner during the same operation to avoid risking tearing the box or liner. The user can open the box and the liner to pour out the contents in one motion and easily close and seal the box and the liner so the contents do not spill out. Advantageously, the box is formed from a single blank piece of cardboard or similar stock, and a single planar sheet of moisture impervious material adhered onto the blank which folds with the blank to form a sealed liner or bag, such that the slide ends up inside the box for easy assembly with a resulting sealed bag inside.

17 Claims, 14 Drawing Sheets

SLIDE OPENING BOX WITH INTEGRAL LINER

This application is a continuation-in-part of U.S. patent application Ser. No. 13/175,779, filed on Jul. 1, 2011.

BACKGROUND

The present disclosure relates to packaging for pourable materials, and in particular, to a box with a slide opening and an integral liner for containing and dispensing pourable items such as cereal or other foodstuffs.

A wide range of pourable products such as dry cereals, small cookies or crackers, pet foods, powdered laundry soap and many others are held in and dispensed from cardboard box containers. Often, to preserve the freshness of food products and prevent leakage of fine particle food and other products, these boxes enclose a sealed waxed paper or plastic bag for holding the manufactured product. While effectively containing and preserving the manufactured products, opening such a container is a cumbersome process. A user must open the top of the box and then manipulate and tear open the bag held within. If the sealed top of the bag is not carefully torn open, the bag may rip down the side, spilling product.

Conventional folding cartons are also ill suited for reclosure, especially since users customarily dispense only a portion of the contents at a time. After opening the box and dispensing some of the product, users must attempt to reclose the bag by folding or rolling up the open top. This must be done with the bag in the box (if removed, the bag may deform and no longer fit), and results in a partially closed unsealed bag prone to spilling product between the bag and the box.

The containers themselves are also difficult to close. Typical closures are the cartons flaps glued onto each during manufacture. For commercial cereal boxes, after opening, to close the box users must open a slit in the flap and bend the flap of the box top to insert a tab in the slit. Opening the box top frequently results in tearing and ruining the closure. Also, the slit must be opened along a perforation, which frequently results in tearing it to the edge of a flap also rendering the closure inoperable. Even if the slit is preserved and the tab carefully inserted therein, the closure is prone to unwanted opening.

Standard cereal boxes are typically delivered in a tube-shaped standard folding carton, partially assembled and collapsed condition. When manufacturing boxes in large quantities, e.g. for mass distribution of breakfast cereals, it is preferable to have the box delivered to the filling machine as a folded flat. Automated machinery at the food processor opens up the flat carton, folds and secures top or bottom flaps to form a box with an open end. Next the filling machine fills the box with product, and then glue closes the box to be a ready consumer package.

Applicant has developed packages of new and differing functionality which offer significant improvements in dispensing, closing and reopening yet maintaining the manufacturing and filling process the same as standard folding cartons which work with conventional high speed machinery, over the prior art, and keeping the look of a standard carton for the consumer's familiarity. Applicant is the named inventor on numerous U.S. patents directed to specialty packaging including U.S. Pat. Nos. 6,116,499, 6,273,332, 6,360,942, 6,435,402, 6,945,449, 7,040,528, 7,156,286 and 7,743,973, and application Ser. No. 12/686,252 filed Jan. 12, 2010. These patents and the pending application show the progression of Applicant's innovative packaging designs, and how they have evolved to become friendlier to the high-speed form, fill and seal machines used by major food processing companies in producing hundreds of packages per minute.

While Applicant's display package design and the technology described in existing patents offer many advantages over the prior art, there remains a need for a mass producible box with a sealed bag inside, for storing and maintaining the required liner by cereal manufacturing companies, while providing dispensing portions of the contents and re-closing the box with ease. The need exists for a box for containing pourable items where the liner bag is conveniently constructed along with the box, and the liner bag can be opened and closed as the box is opened and closed by a convenient slide opener. The need also exists for a box capable of maintaining high speed production manufacturing that can actually be manufactured by the food companies because it offers the economical advantage of high volume mass production.

SUMMARY

A box having an integral liner for containing pourable items and a method of packaging and dispensing pourable products, such as cereal in a high speed production line that is friendly to existing packaging machinery, is disclosed. A box having an integral liner is thrilled from a foldable box blank. The foldable box blank has a plurality of sides coupled together, each of the sides corresponding to a side of the box when folded. The foldable box blank is preferably made of single sheet cardboard or similar material, which may be stamped to create fold lines and perforations.

A first side of the box blank has a dispensing and closing mechanism technology serving as the opening through which pourable product will be dispensed. Coupled to the first side opening, a slide allows the box to be opened and closed when the package is used. The slide may be coupled to the first side prior to assembly, allowing the package to be constructed specifically from a single flat piece of box blank stock for high speed line assembly. Additionally, the box opening can be placed virtually anywhere on the box convenient for pouring. This box design, while incorporating a dispensing mechanism, is made the same way as conventional boxes already on the market with the same advantages of mass production. It offers a convenient side pouring feature and recloses without tearing the box or the bag in it, thereby avoiding the problems of reclosing an opened and/or damaged bag, and the likelihood of destroying the tab and slot closure on a conventional box top.

As moisture and dust proof along with freshness is a desired and necessary characteristic of the goods contemplated to be held in and dispensed from the box, a bag substantially sealed inside the box forms part of the package. The bag may be made from a moisture impervious material, including a heat-sealable plastic-type material known to skilled persons for maintaining the freshness and dryness of contained items, or materials known and used in conventional cardboard box sealed bags which satisfies these purposes.

Typically the moisture impervious material substantially covers the box blank prior to package assembly. Opposing sides of the moisture impervious material may be brought together beyond the edge of the box blank to form two layers that are sealed. By also sealing the bottom or top edge of the moisture impervious material, and folding the blank into a box shape, a bag with an opening adjacent the open top or bottom of the box is automatically formed.

The moisture impervious material preferably has a perforated portion, defining an opening, overlaying and aligned with the side opening of the box. The opening of the moisture impervious material liner and the side opening of the box are preferably sealed together to prevent product from lodging between the bag and the box after initial opening. The moisture impervious material may also extend past the slide, and substantially past an edge of the box blank corresponding to the bottom or top of a completed box. By sealing the openings of the box and bag, once the moisture impervious material is completely sealed to hold product, a substantially air-tight re-sealable package is produced.

As discussed, once the fold or manufacturing joint is sealed, the blank is ready to be formed the same way as a conventional box by first sealing the bottom or the top portion of the liner and then the bottom or top portion of the blank, ready to be filled and to be sealed to form a complete package. Once product is introduced into the package, it may be closed and sealed until opened by a user. Glue or a similar adhesive may also be used to attach selected portions of the bag, notably around the opening, to the box blank. Using the integral liner also eliminates the empty corners found in conventional cereal boxes with bags, and thus makes it possible for manufacturers to use smaller boxes saving on paper and the environment.

Completing the method, to use the package, a user lifts open the slide opening to expose the opening in the bag inside the box. In one embodiment, it is anticipated the slide will have a first portion adapted to slide along the first side of the box, and a second portion adapted to extend away from the box top. It is also anticipated that the slide may comprise a tab allowing a user to actuate the slide more easily. In an alternative embodiment, a removable patch (not shown) may also be sealed over the perforated portion.

Conventional boxes require users to carefully separate the glued together box top flaps often resulting in tearing, and having no ability to reclose the interior sealed bag. In contrast the present invention simply requires that a user lifts up on the lid, thereby opening the slide, with the optional additional step of removing a tab over the slide sealing the interior bag, e.g. pushing in the perforated area, for dispensing products from the inner bag.

Upon first use of the slide, the box opening is exposed along with the section of the bag to be opened. A user may remove the section of the bag, which is typically surrounded by perforations, to access the product. In addition to the perforated opening being located overlaying the box opening, in one embodiment, a tab may be present adjacent the perforated portion of the bag to facilitate removal. Once the portion of the bag surrounded by perforations is removed, with the slide in an open configuration, product may be poured through the side opening.

Once a desired amount of pourable product is dispensed from the box, a user may push close the opener to close the box and cover the inner bag. Without further actions by the user such as folding over the bag or clipping it closed, freshness of the pourable product in the package will be preserved. Due to the position of the opening on the side of the box and tabbed slide, the slide may be engaged with a user's thumb in one embodiment. In order to prevent the portion of the slide covering the opening from dislocating from the box, the slide may be equipped with one or more stops adapted to limit sliding movement of the slide.

In one alternative embodiment, it is anticipated that the sheet of moisture impervious material may be in a folded condition prior to the steps of sealing opposing edges of the moisture impervious material to form a bag and attaching the bag to the box blank. In this embodiment, the folded sheet of moisture impervious material also has an opening defined by perforations adapted to overlay the side opening. It is anticipated that the method of use of the assembled package in this embodiment will be substantially the same as in other embodiments.

In a second alternative embodiment method of packaging and dispensing pourable product a box blank is formed having a plurality of sides coupled together, including a first side having a side opening coupled to a slide covering the side opening. A sheet or liner of moisture impervious material is attached to the box blank, substantially covering it. The liner has an opening overlaying the side opening. An adhesive may be applied to a predetermined portion of the sheet for attaching to another portion of the sheet for forming a sealed tube from which the sealed bag is formed.

The box blank is then formed into a box with the liner forming a bag inside the box. Thereafter the bottom edges of the liner may be sealed forming a sealed bag inside the box. In this manner, a multiplicity of the boxes may be stacked in a collapsed configuration for later use prior to opening the boxes from the collapsed configuration for filling with the pourable product. The bag is then filled with the pourable product, and the top of the bag sealed. Thereafter, a user may open and close the box in the manner according to the first embodiment.

DESCRIPTION

Figure 1:
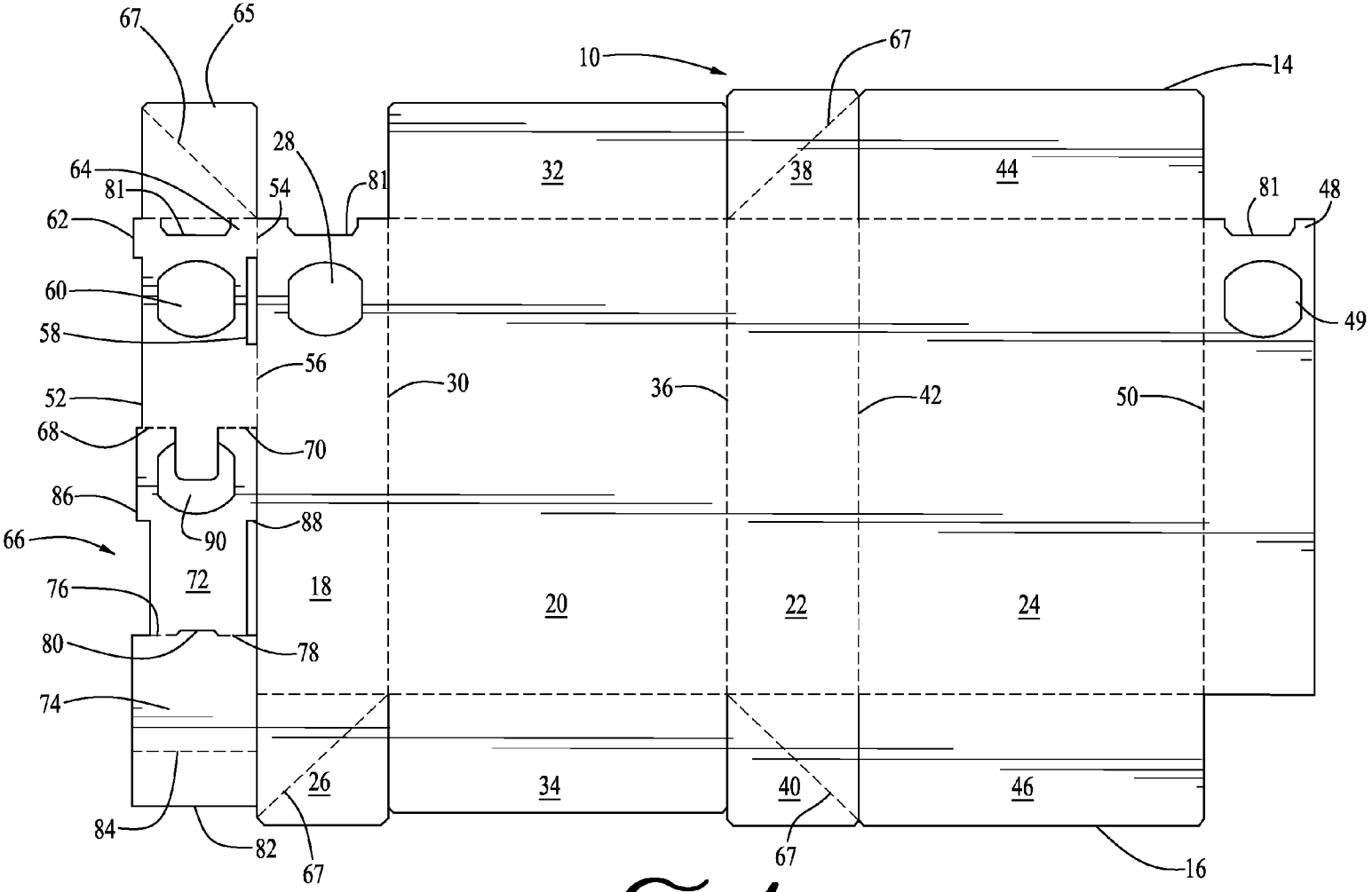
FIG. 1 is a flat pattern view of the blank from which an embodiment of the box is made.

FIG. 1 illustrates one embodiment of a die cut paper or cardboard blank 10 that may be used to form the box 12. The blank 10 has a top end 14 and a bottom end 16 and is scored for folding between a first minor side 18, a first major side 20, a second minor side 22 and a second major side 24, all generally rectangular in shape. The first minor side 18 includes flap 26 and aperture 28 and is attached to the first major side 20 by fold line 30. The first major side 20 includes major flaps 32 and 34 and is connected to second minor side 22 by fold line 36. The second minor side 22 includes flaps 38 and 40 and is connected to second major side 24 by told line 42. The second major side 24 includes flaps 44 and 46 and is connected to the overlapping flap or manufacturer's joint 48 (which includes aperture 49) by fold line 50.

Still referring to FIG. 1, the slider retention portion 52 is attached to the first minor side 18 along fold lines 54 and 56 with a slotted opening 58. The slider retention portion 52 is formed with aperture 60 and includes the stopper tabs 62 and 64 and a minor flap 65. The slider retention portion 52 is attached to the slider 66 along perforated lines 68 and 70. The slider 66 includes the slide 72 which is connected along fold lines 76 and 78 to the lifting flap 74 and includes the tab 80 configured for engagement by a user's thumb when folded, and small cutouts 81 in the minor sides 18, 22, and 48 to provide easy access to the tab 80. The lifting flap 74 is attached to the attachment portion 82 along fold line 84. The slider 66 is formed with aperture 90 and includes tabs 86 and 88. The minor flaps 26, 38, 40 rather than being entirely separated from the major flaps 32, 34, 44, and 46 have instead a line of weakness or are perforated. Additionally, the minor flaps 26, 38, 40, and 65 have a fold line 67 the function of which is explained below.

Figure 2:
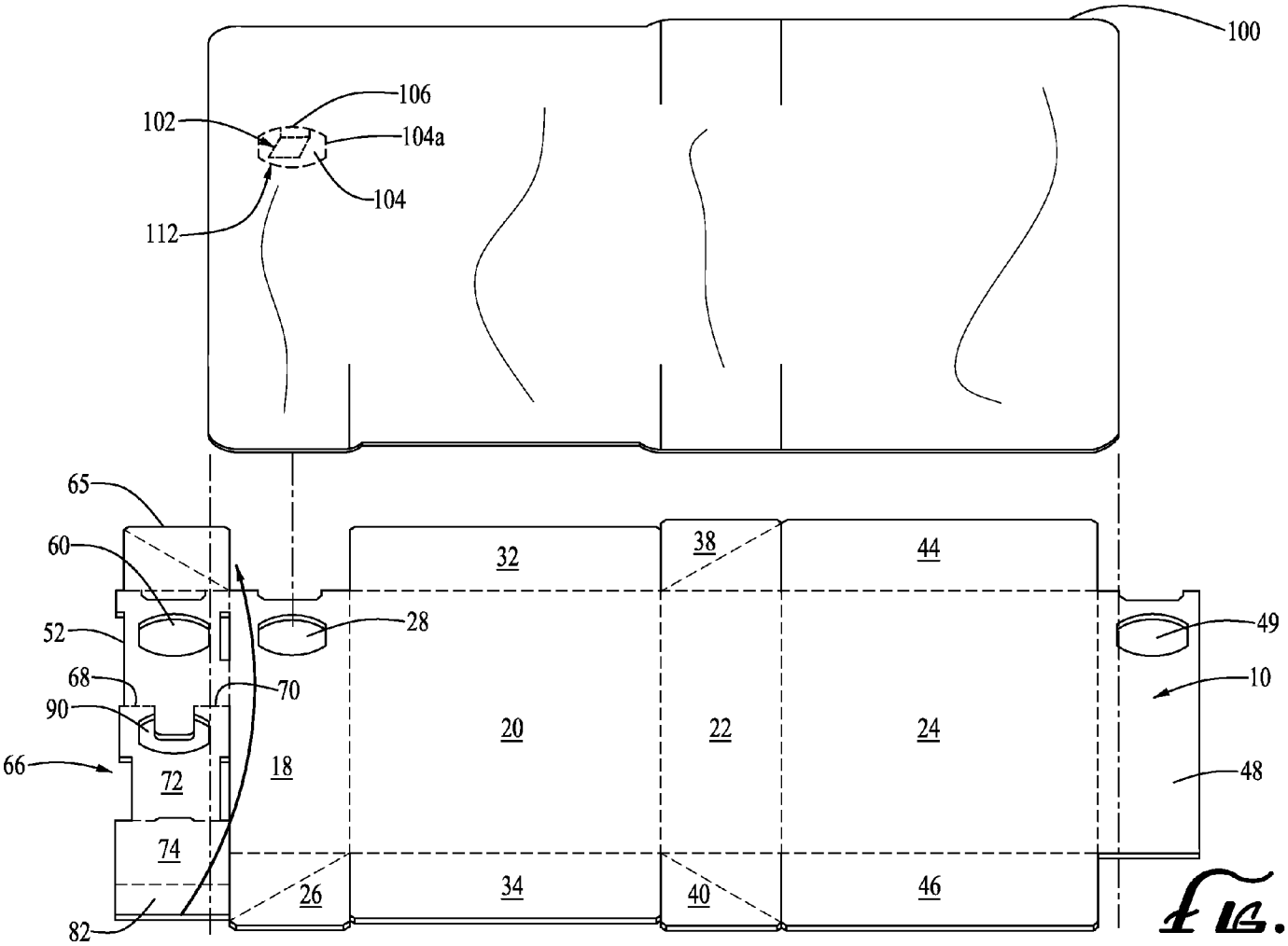
FIG. 2 is a perspective view of the blank and the liner material adapted to cover the blank, also showing an initial assembly step.

FIG. 2 illustrates an embodiment with the liner 100 shown prior to being affixed to the blank 10. The liner 100 includes an opening 112 and a liner flap 102. The liner flap 102 is attached to a connector portion 106 connecting it with the liner 100 and removable liner portion 104. The liner 100 is connected to the removable liner portion 104 with a perforation line 104*a*. As can be appreciated from FIG. 2, pulling flap 102 away from the liner 100 removes the removable liner portion 104 along perforation line 104*a*. The liner 100 is preferably made of a plastic, waxed paper, or other materials known to persons skilled in the art for containing pourable items in a box in a fresh or dry state. The apertures, 28, 49, 60, and 90, and liner opening 112 are all compatible in shape, although not necessarily the same shape, such that when the four openings are aligned as discussed herein, a path is provided from the interior of the box to the exterior.

Figure 3:
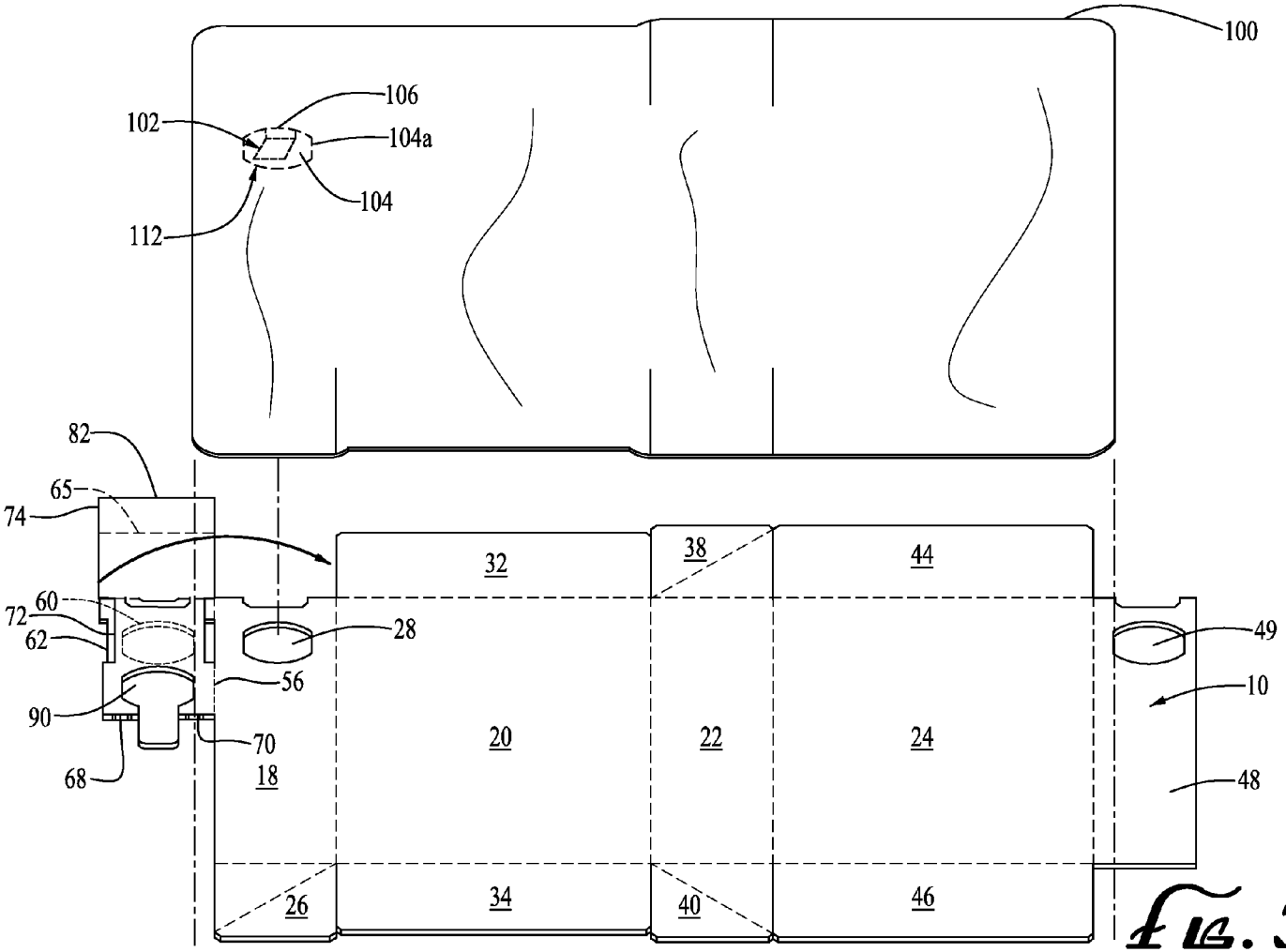
FIG. 3 is a perspective view of the blank and liner material, also showing subsequent assembly steps.
Figure 4:
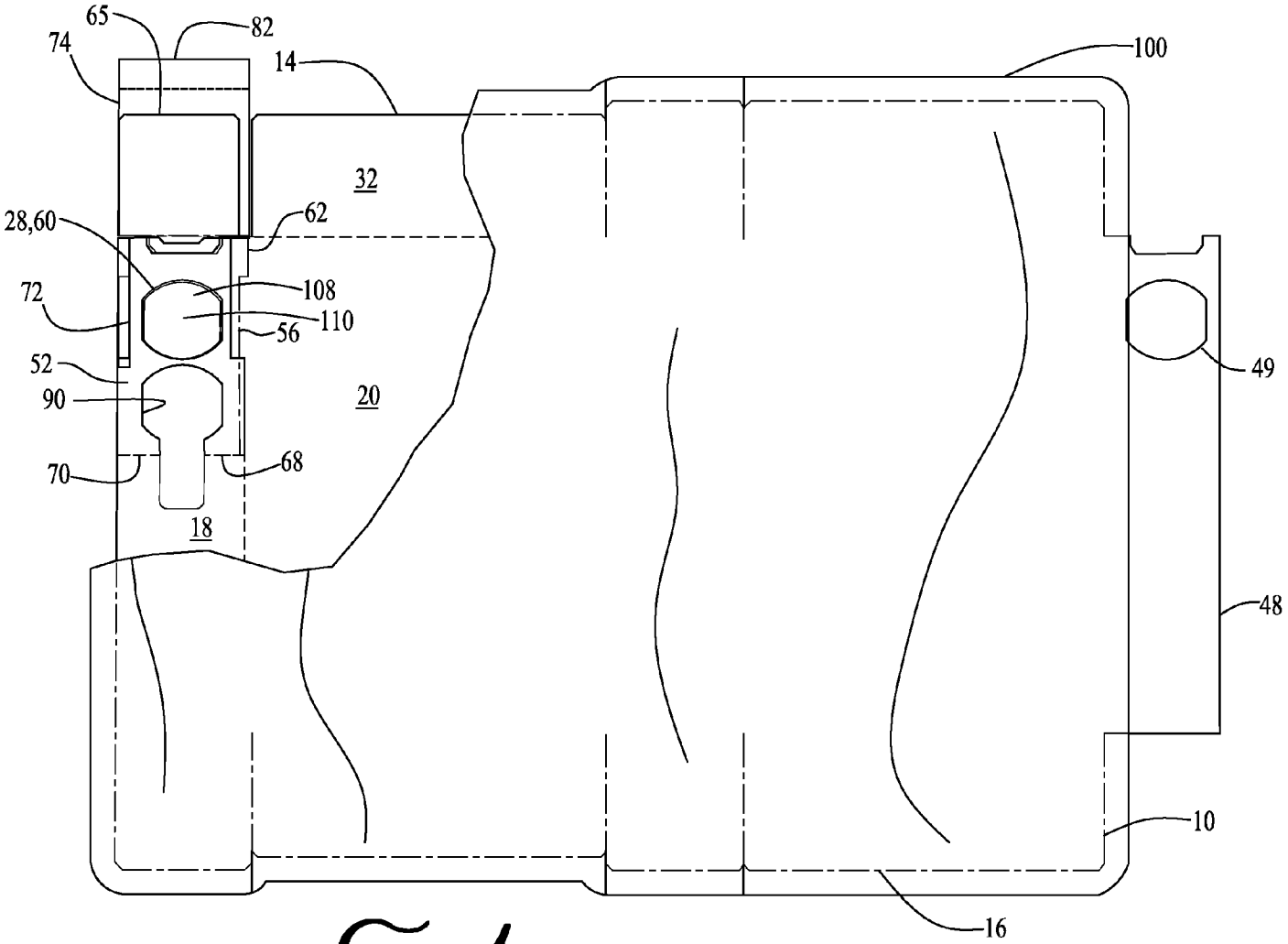
FIG. 4 is a plan view of the partially assembled box showing the lifting flap in one embodiment of the invention and a portion of the liner material cut away for clarity of illustration.

Still referring to FIG. 2, construction of the box 12 begins with folding the slider 66 over onto the slider retention portion 52 along perforated lines 68, 70. Referring to FIG. 3, the overlapping slider 66 and slider retention portion 52 are then folded over onto minor side 18 along fold line 56. The liner 100 is then affixed to the blank 10 and glued or otherwise adhered to the blank 10 to secure the liner 100 thereto such that the liner opening 112 is placed substantially in alignment with aperture 28 of the first minor side 18. As shown in FIG. 4, in one embodiment, the liner 100 extends about a half inch (0.5 in.) beyond the top end 14, the bottom end 16, and about that same distance into the overlapping flap 48 and extending over onto portions of slider retention portion 52 and the slider 66. In one embodiment a series of small glue dots, not shown, are deposited on the blank 10, particularly near the aperture 28 to ensure proper alignment is maintained, as well as across the remainder of the blank 10.

Figure 5:
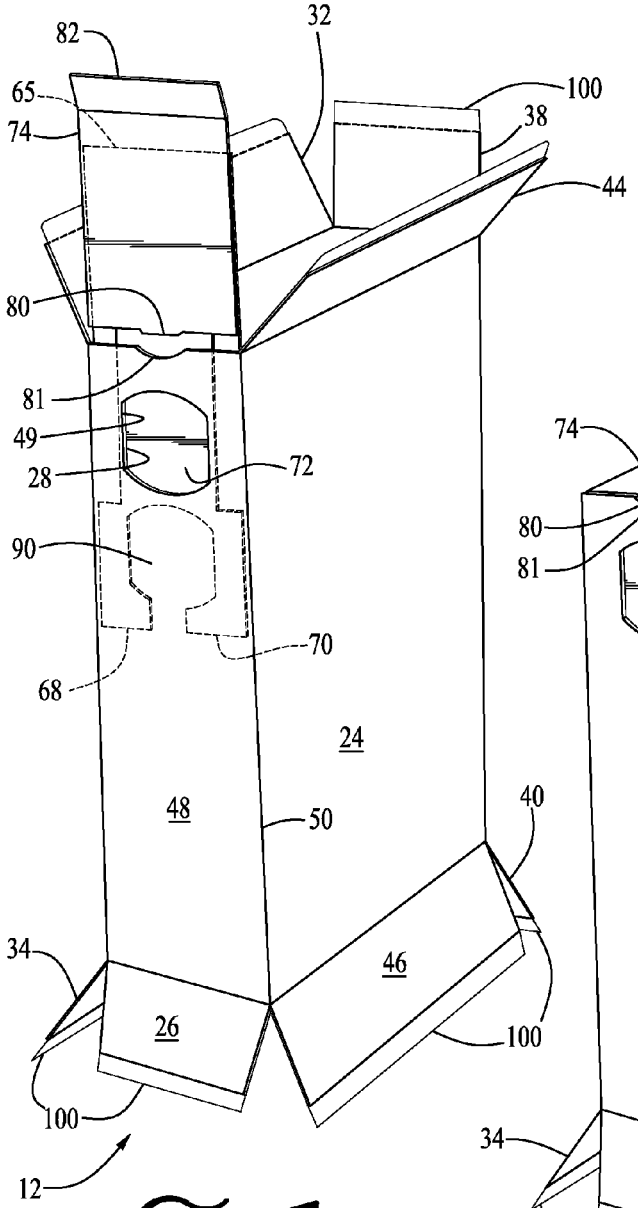
FIG. 5 is a front perspective view or the box showing assembly of the lifting flap and hidden components of the lifting flap in dashed line.

To continue box assembly, the slide 72 is situated under the slider retention portion 52 and the liner 100 with the slide 72 in communication with the liner flap 102. Further, the overlapping flap 48 is folded along fold line 50 so that it is approximately perpendicular to second major side 24 and then similarly folding between second major side 24 and second minor side 22 along fold line 42, folding between second minor side 22 and first major side 20 along fold line 36 and then folding between first major side 20 and first minor side 18 along fold line 30. The overlapping flap 48 is then glued or otherwise adhered to the first minor side 18 to form a generally rectangular box 12 as shown in FIG. 5.

Figure 6:
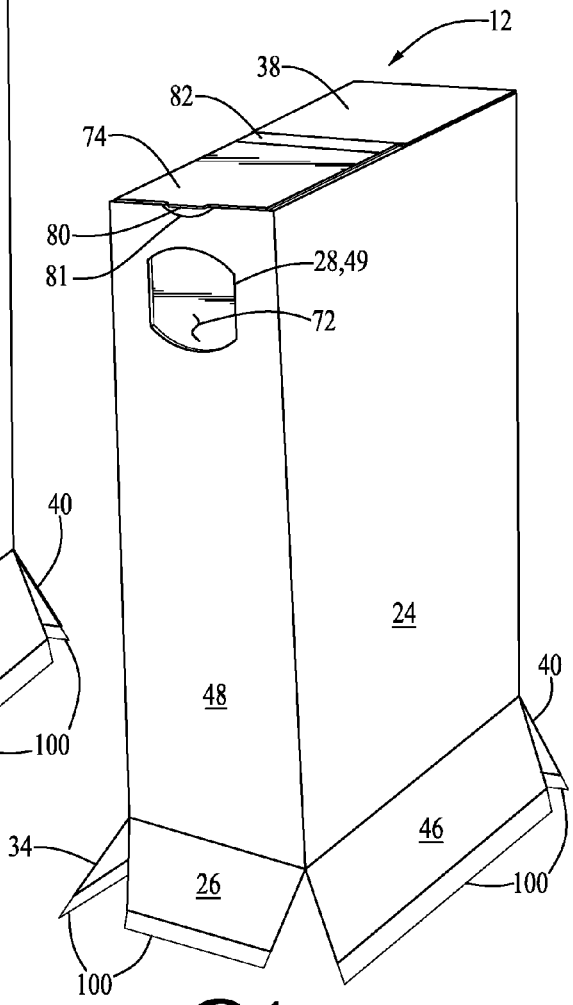
FIG. 6 is a front perspective view of the box showing the lifting flap in a dosed configuration.

FIG. 6 shows the box 12 further assembled with flaps 32, 44 and 38 folded over and glued or otherwise adhered together to close the top of the box 12. The lifting flap 74 is also folded over onto the folded flaps 32 and 44 with the attachment portion 82 glued or otherwise adhered thereto. FIG. 6 also shows the tab 80 on the lifting flap 74.

Figure 7:
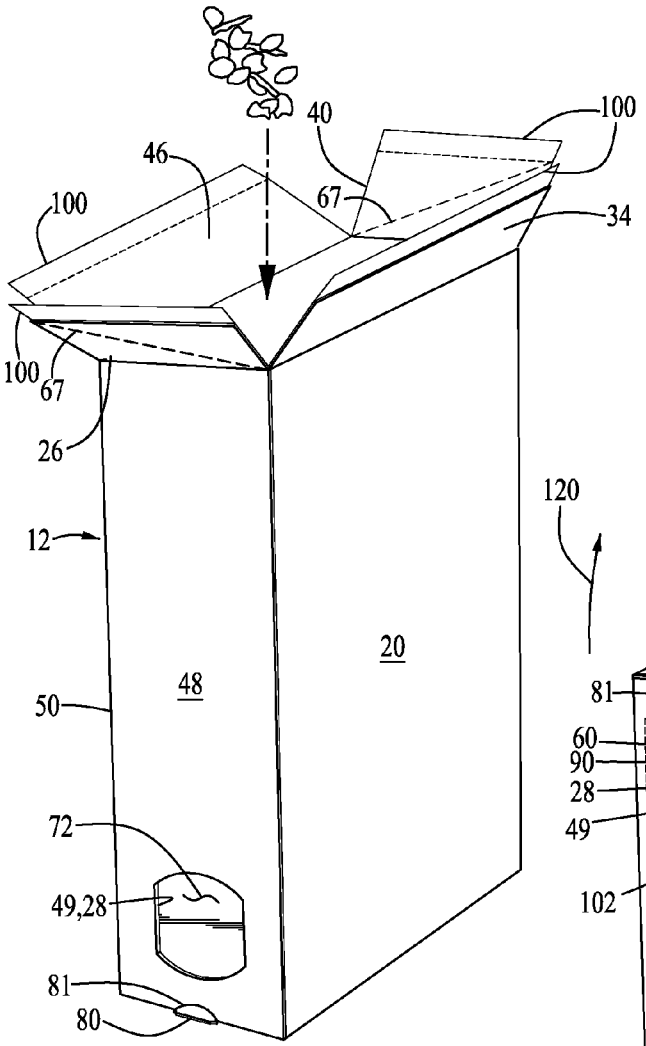
FIG. 7 is an inverted front perspective view of the box being filled from the bottom with pourable product.

FIG. 7 shows the box 12 being filled from the bottom with pourable product prior to final assembly, which is one method of filling the assembled box 12. Final assembly of the box 12 is accomplished by folding over flaps 26 and 40, and then flaps 46 and 34, which are then glued or otherwise adhered together to close the bottom of the box 12 to hold the pourable product. As mentioned above, flaps 26 and 40 may be scored with fold lines 67, which helps retain all the cereal or other product and prevents dust or small particles of product from being released from the box as it is closed. Assembling the package in this manner creates a box with a sealed, air-tight liner bag inside to keep the cereal or other pourable product dry and fresh.

Figure 8:
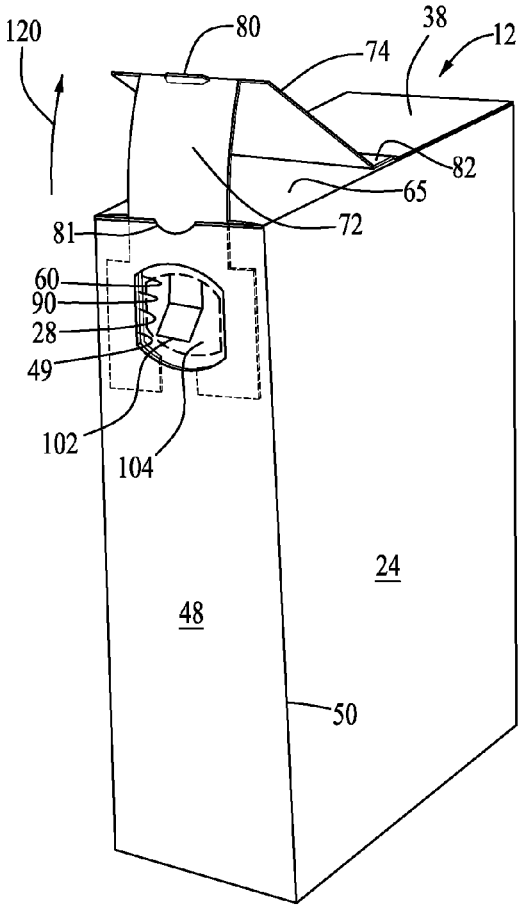
FIG. 8 is a front perspective view of the box showing operation of the slider and lifting flap.

FIG. 8 shows a manner of dispensing pourable product from the box 12 following removal of the liner cover 104 from the liner 100. The tab 80 is lifted by a user's thumb in the direction of the arrow 120 to move the slide 72 upward to align the aperture 90 with the aperture 28 on the first minor side 18. The stopper members 62, 64 prevent advance of the slide 72 beyond the first minor side 18 by engaging the tabs 86, 88 on the slide 72. The liner opening 112 is created by pulling the liner flap 102. The pourable product within the box 12 is then dispensed from the box 12 through the liner opening 112 and out through apertures 90 and 28. Pushing down on the tab 80 in the opposite direction of the arrow 120 moves the slide 72 back down to close the aperture 28 and also to close the liner opening 112.

Figure 9:
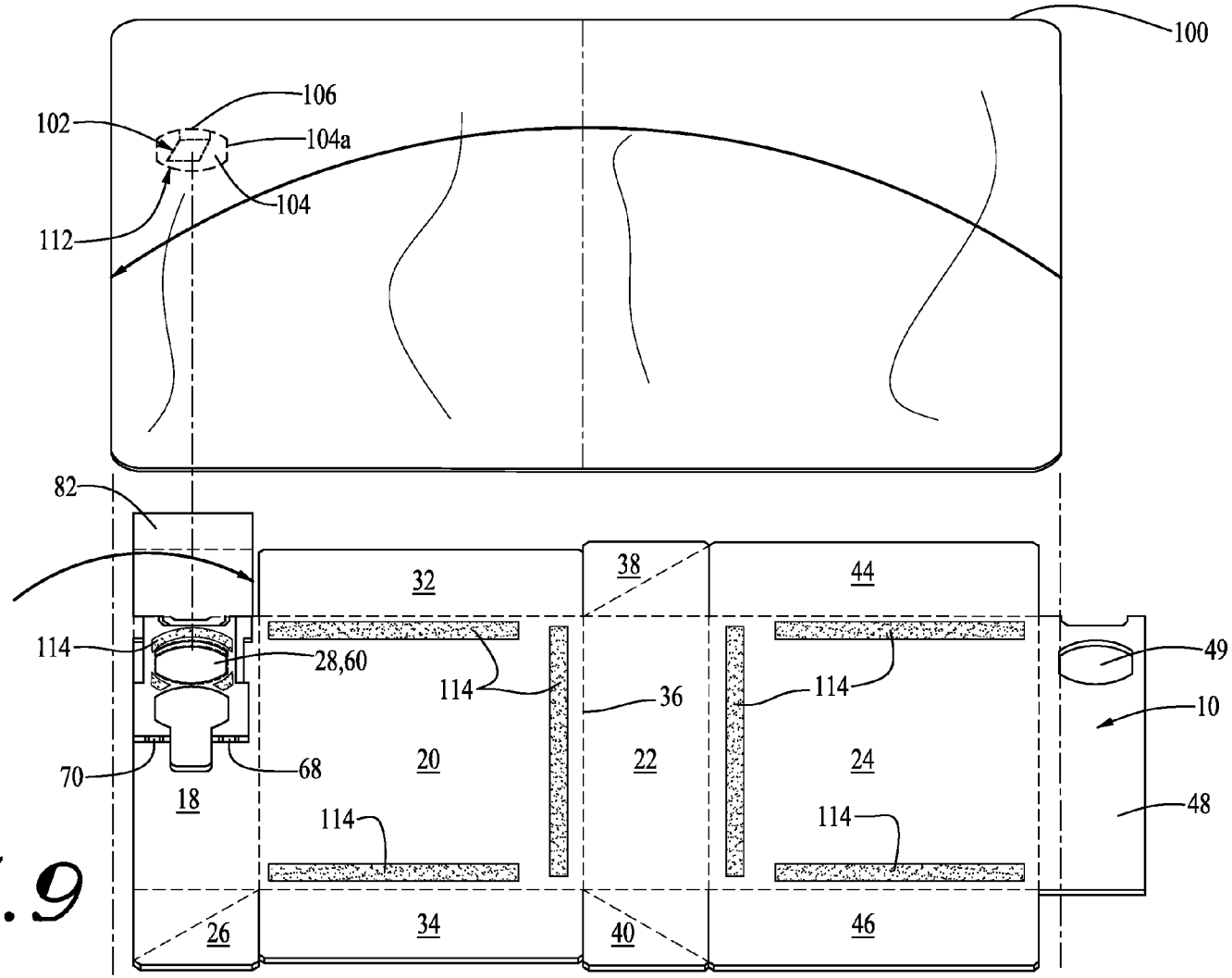
FIG. 9 is a perspective view of an alternative embodiment of the invention showing a liner separate from a blank having adhesive areas.

In some embodiments, it may be preferable to prepare the liner 100 and blank 10 for assembly by passing the blank 10 and liner 100 through hot rollers or other sealing apparatus under pressure. Referring to FIGS. 9-14, an alternative method of forming and attaching the liner 100 and assembling the box 12 is shown. In FIG. 9, the liner 100 is folded along fold line 36 as the overlapping slider 66 and slider retention portion 52 are folded over onto minor side 18 along fold line 56 (See, FIG. 3).

Adhesive strips 114 incorporated onto the surface of the unassembled blank 10 are designed to hold the liner 100 in position as the blank 10 is folded into a three-dimensional box 12. Although adhesive strips are contemplated, alternative embodiments may employ adhesive in spots, not shown, across predetermined portions of the box blank, or in another configuration to support the bag in position.

Figure 10:
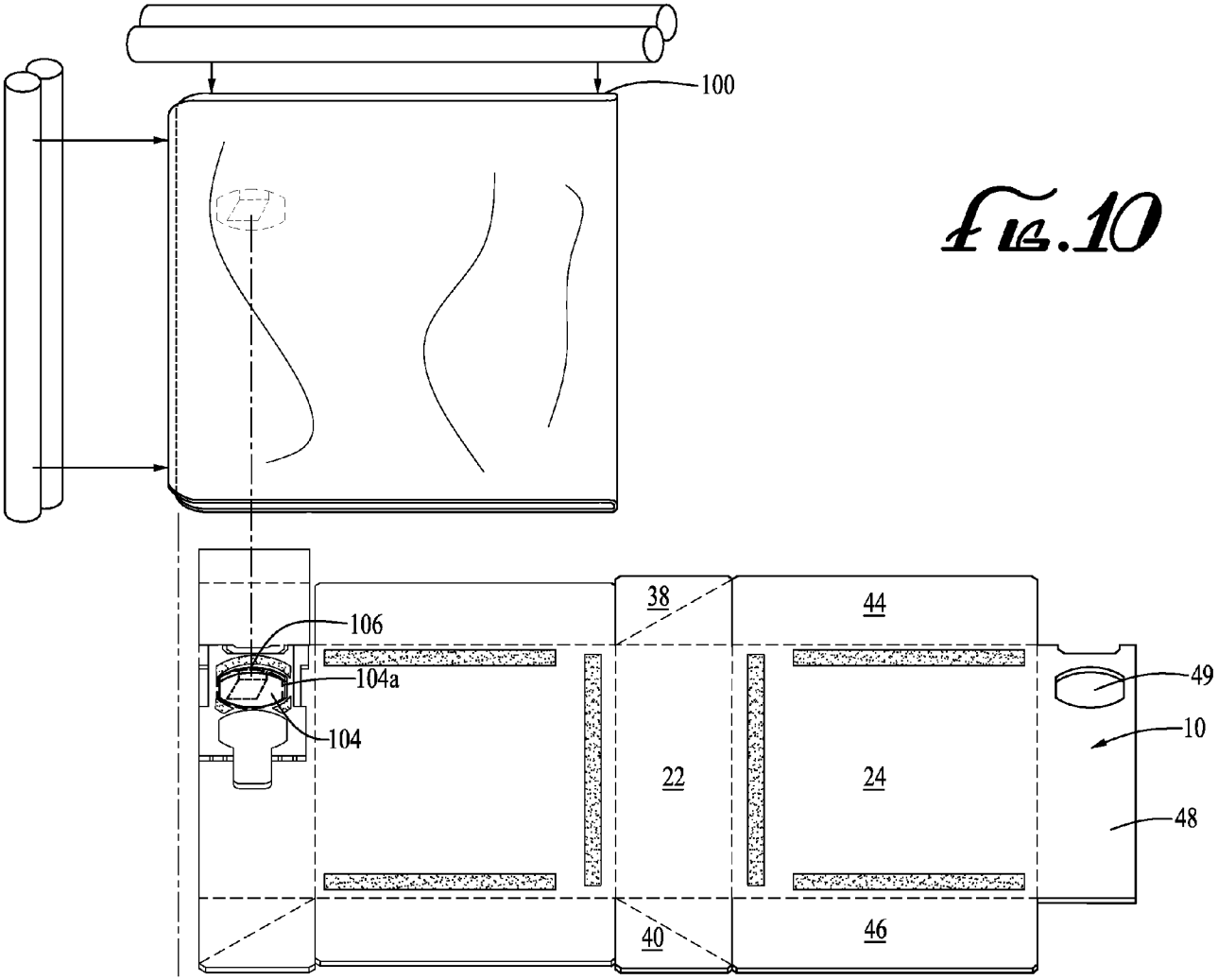
FIG. 10 is a perspective view of a liner folded and adhered to a blank by compression, and hot rollers sealing edges of the liner forming a bag.

Referring to FIG. 10, with the liner 100 folded over the blank 10, hot pressure is applied to seal the liner 100. In one embodiment, the liner 100 may be passed through a hot rolling mechanism.

Figure 11:
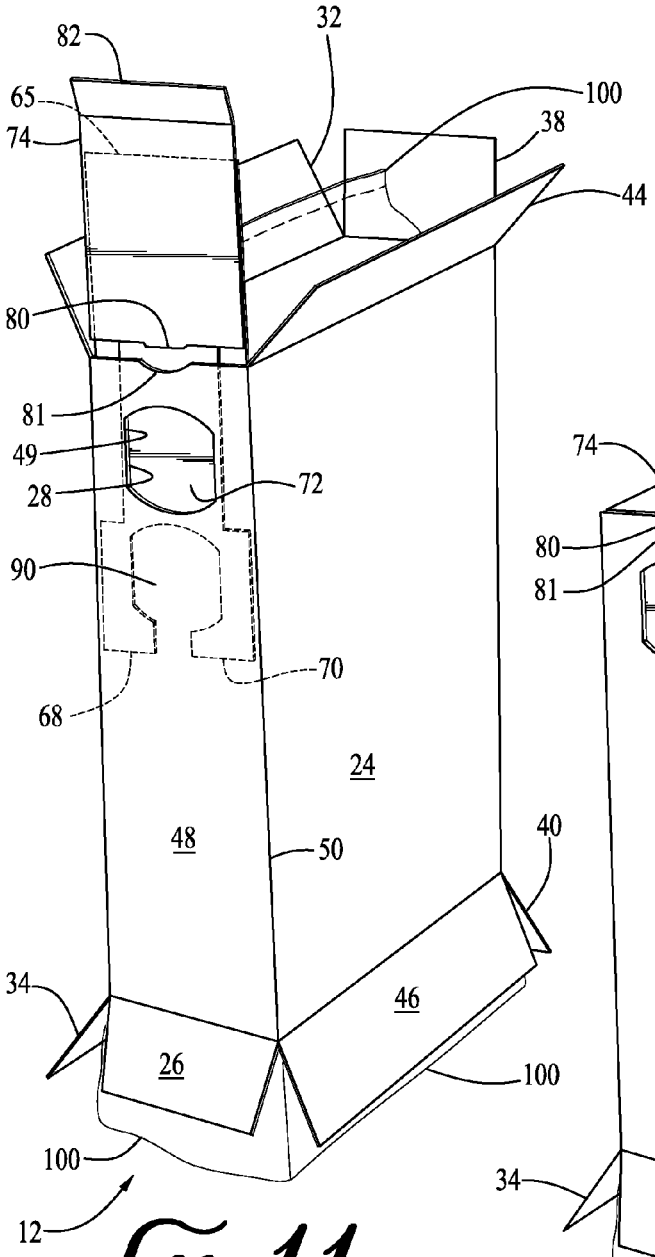
FIG. 11 is a front perspective view of the box showing the sealed bag inside the box prior to closing the box bottom.
Figure 12:
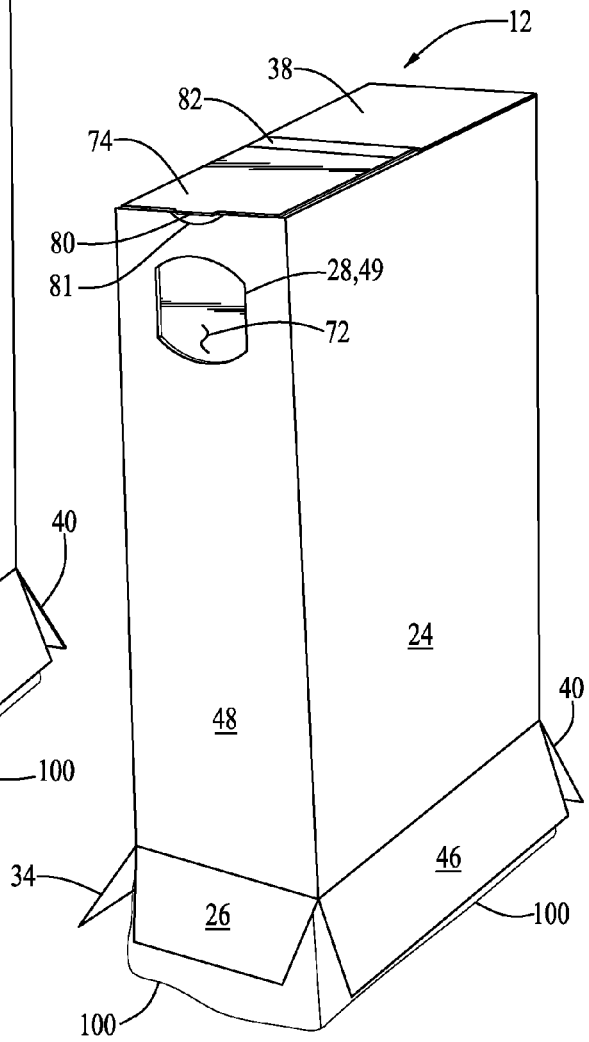
FIG. 12 is a front perspective view of the box prior to filling and closing the box.

As shown in FIG. 11, the liner 100 is glued and closed proximal the top of the box prior to assembly of the flaps 32, 44, and 38, which are folded over and glued or otherwise adhered together to close the top of the box 12, along with the lifting flap 74 which is folded over onto the folded flaps 32 and 44 with the attachment portion 82 glued or otherwise adhered thereto (See FIGS. 5-6). In this manner of assembly, in one alternative embodiment, the side of the liner 100 adjacent the bottom of the blank 10 is left unsealed. In one embodiment, due to adhesion with the blank 10, as the blank 10 is folded into a three dimensional box, the liner 100 at the bottom of the box 12 opens to accommodate pourable product as shown in FIG. 12.

Figure 13:
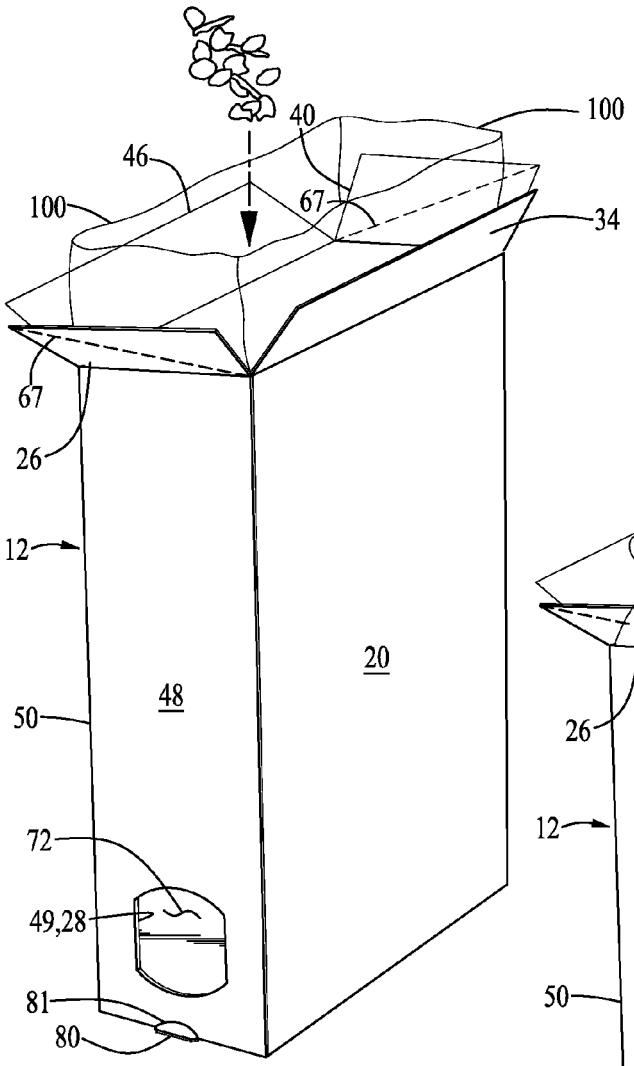
FIG. 13 is an inverted front perspective view of the box being filled from the bottom with pourable product.
Figure 14:
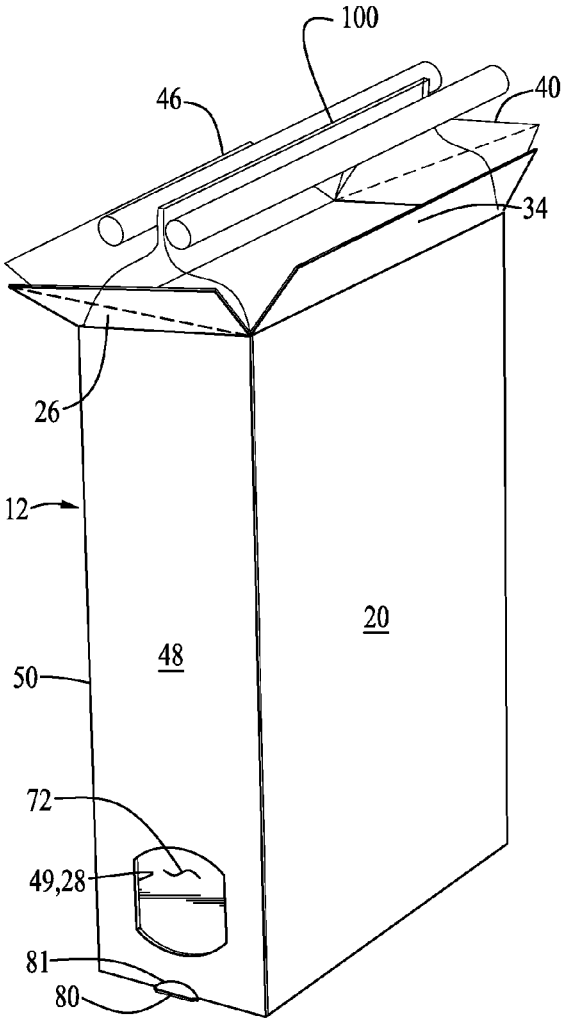
FIG. 14 is an inverted front perspective view of the bottom of the bag being hot sealed prior to closing.

Referring to FIGS. 13 and 14, pourable product is introduced into the box 12 in the same manner as the embodiment shown in FIG. 7. In this embodiment, the liner 100 is not adhered to flaps 26, 40, 34, and 46 prior to introduction of the pourable product. Rather, the product is introduced into the box 12, and thereafter a hot roller or other mechanism is brought to bear against the liner 100, to seal it. Once the liner 100 is sealed, flaps 26, 40, 34 and 46 are closed to create an assembled box 12 having a pourable product contained by a sealed liner 100 therein.

Figure 15:
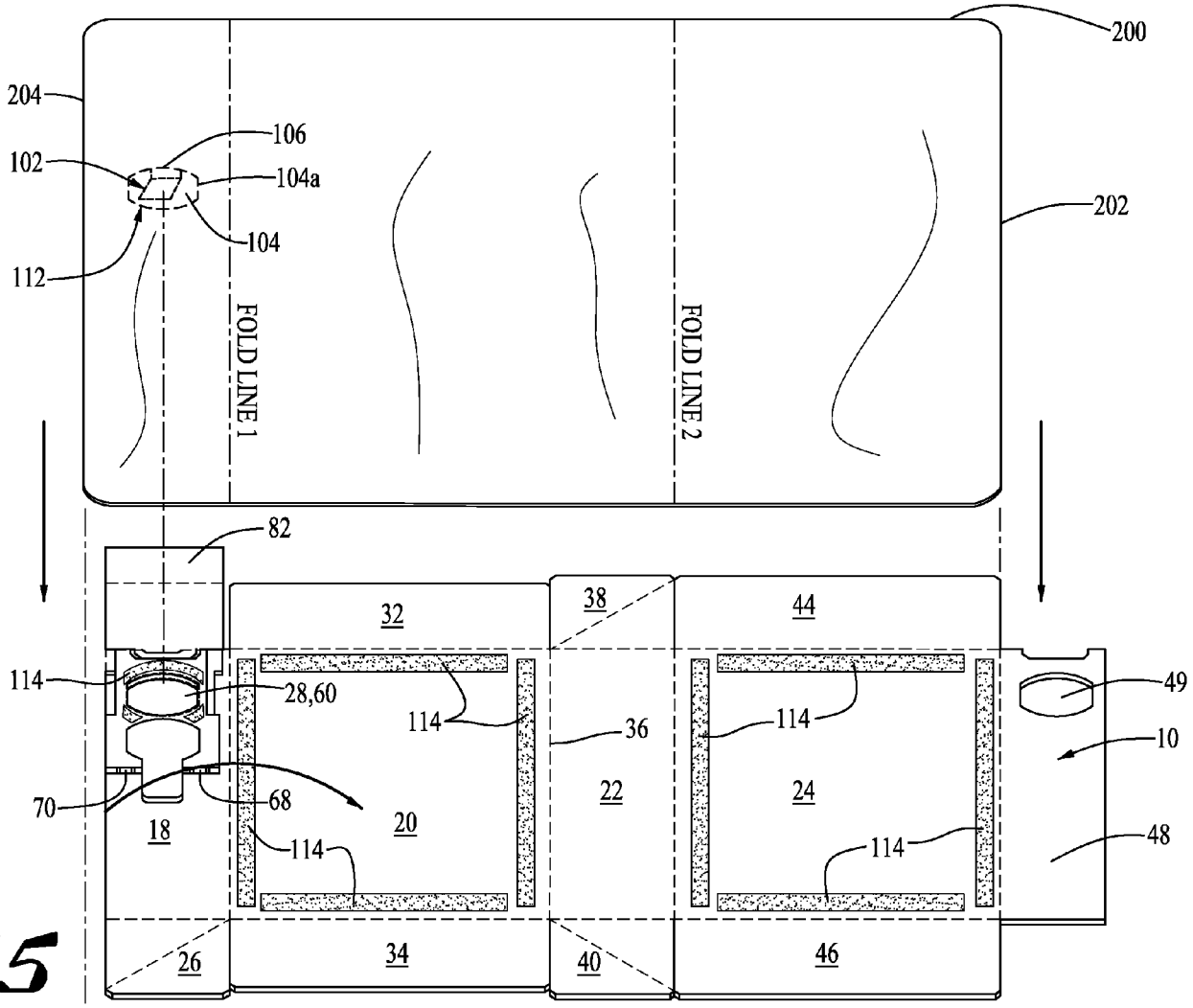
FIG. 15 is a perspective view of a second embodiment of a blank and liner material adapted to cover the blank, also showing an initial assembly step.

Referring to FIG. 15, the box blank 10 according to a second embodiment is shown. In this embodiment, several areas of adhesion 114 are disposed on the box blank 10. Preferably, the areas of adhesion 114 are formed inside the perimeter of the first major side 20 and the second major side 24.

Still referring to FIG. 15, a sheet or liner 200 of moisture impervious material according to the second embodiment is shown. The liner 200 is sized and oriented to have a first edge 202 aligned at the junction between second major side 24 and overlapping flap 48, and to have second edge 204 overhanging the first minor side 18 of the box blank 10.

Still referring to FIG. 15, the liner 200 is adhered to the box blank 10 at the areas of adhesion 114. With the first edge 202 and the second edge 204 of the liner 200 in proper alignment, the removable liner portion 104 will align with apertures 28, 60 on the box blank 10.

Figure 16:
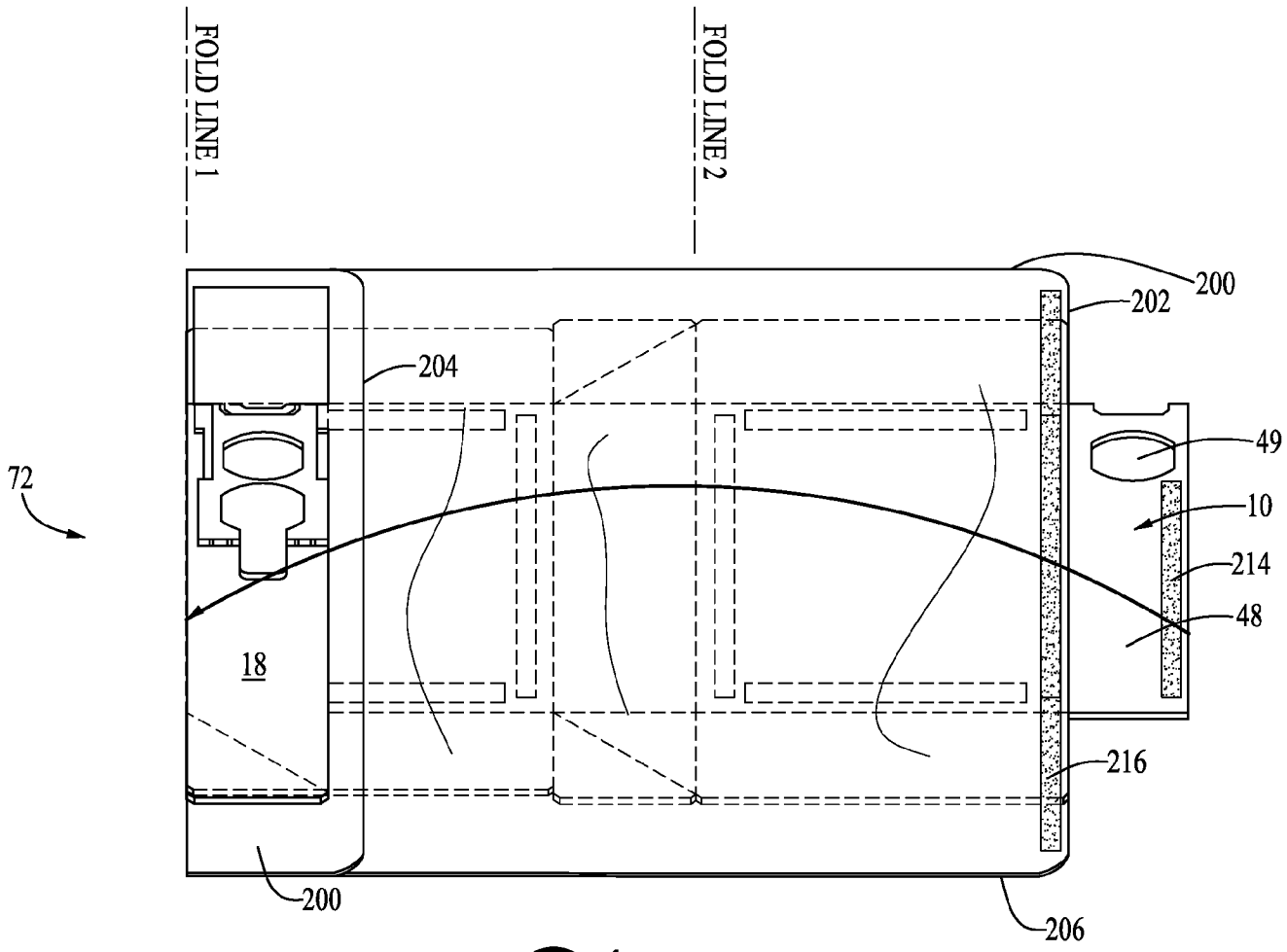
FIG. 16 is a perspective view of the second embodiment with the blank adhered to the liner and partially folded.

Referring to FIGS. 15 and 16, after the liner 200 is adhered to the box blank 10, the liner 200 and the box blank 10 are folded along fold line 1. As shown in FIG. 16, the liner 200 and the box blank 10 also have areas of adhesion 214, 216. The areas of adhesion 214, 216 are located proximal the first edge 202 of the liner 200 and on overlapping flap 48 of the box blank 10.

Still referring to FIG. 16, after the liner 200 and the box blank 10 are folded along fold line 1, the liner 200 and the box blank 10 are then folded along fold line 2. By folding the liner 200 and the box blank 10 along fold line 2, the area of adhesion 214 on overlapping flap 48 adheres to first minor side 18, and the area of adhesion 216 proximal first edge 202 of the liner 200 adheres to the second edge 204 of the liner 200, thereby forming the liner 200 into a sealed tube 218.

Figure 17:
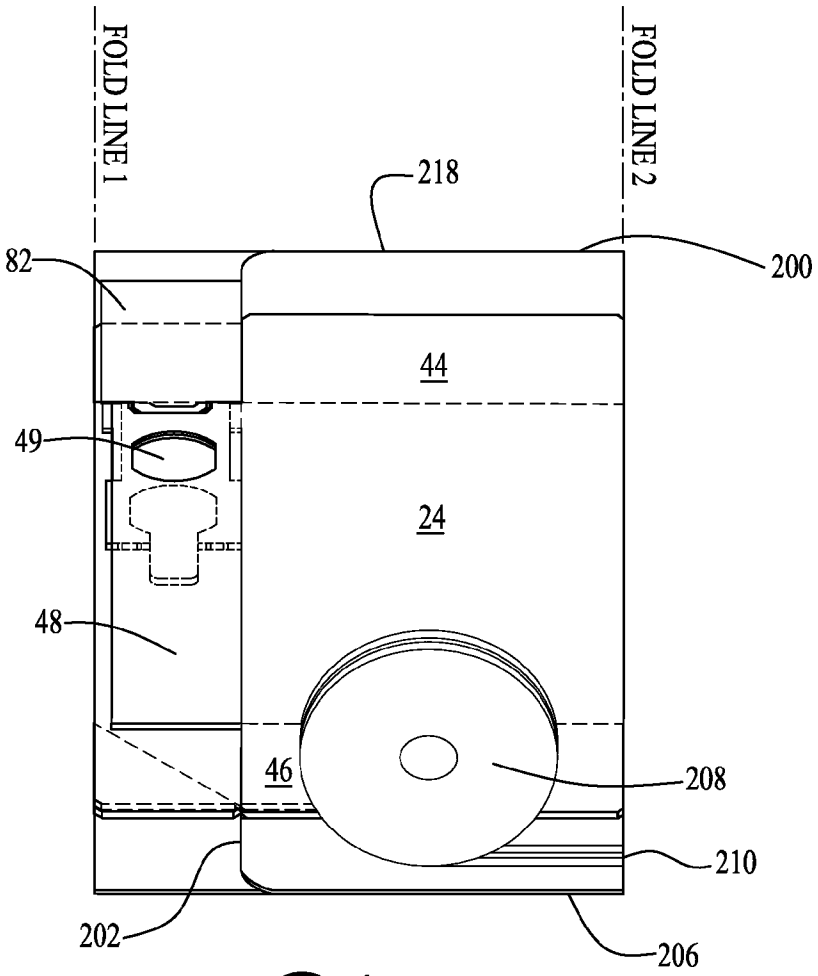
FIG. 17 is a perspective view of the second embodiment in a further folded position, showing the liner being sealed.

Referring to FIG. 17, after the liner 200 and the box blank 10 have been folded along fold line 1 and then along fold line 2, and the sealed tube 218 created, a double-layered bottom portion 206 of the liner 200 remains extending beyond the box blank 10. The layers of the bottom portion 206 are sealed together by a sealing roller 208 or similar mechanism. In the illustrated embodiment the sealing roller 208 creates two parallel sealed lines 210 on the liner 200, although other sealing patterns are contemplated according to preference.

Still referring to FIG. 17, sealing the bottom portion 206 forms an air tight bag with an open top. Sealing the sides of the liner 200 by folding it according to FIGS. 15 and 16, and the adhesive area 216 adhering to the overhanging edge 204 of the liner 200, forms the sealed bag 220 (see FIG. 18). This eliminates the extra steps of independently sealing the sides of the liner 100 according to the first embodiment, shown in FIG. 10. By forming the sealed bag 220 and box 212 initially in a collapsed configuration, multiple collapsed boxes 212 can be stacked before being individually folded open and filled with the pourable product 38.

Figure 18:
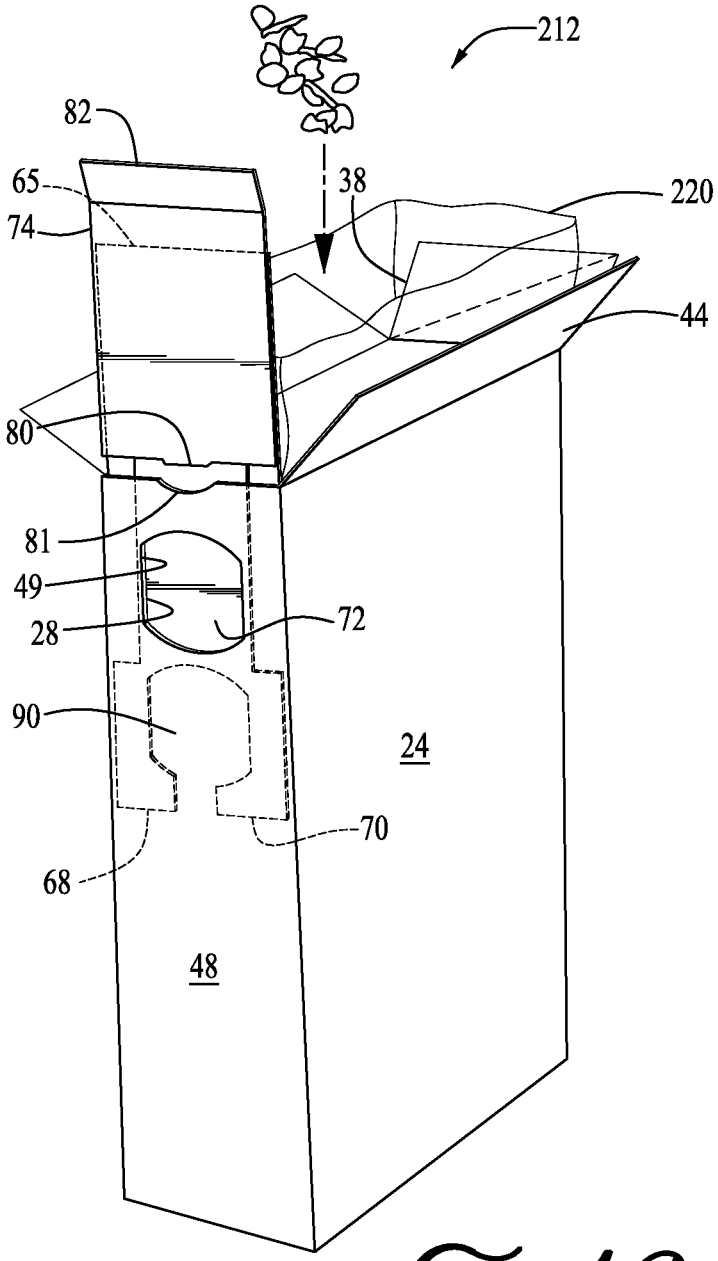
FIG. 18 is a perspective view of the box according to the second embodiment being filled from the top with pourable product.

Referring to FIG. 18, a second embodiment box 212 including the sealed bag 200 is shown being filled from the to with pourable product 38. Once the pourable product 38 is in the sealed bag 220, it may be sealed at the top to contain the pourable product 38 in an airtight manner.

While particular forms of the invention have been illustrated and described, it will also be apparent to those skilled in the art that various modifications can he made without departing from the spirit and scope of the invention. Accordingly, it is not intended that the invention be limited except by the full breadth and scope of the appended claims.

What is claimed is:

1. A method of packaging and dispensing pourable product comprising:

forming a box blank having a plurality of sides coupled together, a first side having a side opening and a retention portion coupled thereto, the retention portion being folded over to at least partially overlay a slide disposed against the first side to cover the side opening, the box blank being thereby partially folded;

attaching a liner of moisture impervious material to substantially cover the partially folded box blank to form a covered box blank, the liner having a removable portion defining an opening overlaying the side opening, the slide being spaced from the liner by the retention portion in the covered box blank;

forming the covered box blank into a box by folding, the liner folding concurrently with the sides of the box blank along a plurality of fold lines defined between the sides to substantially form a bag inside the box;

filling the bag with the pourable product;

selectively moving the slide uncovering the side opening and the opening in the liner, thereby opening the box and the bag with one movement; and dispensing the pourable product through the side opening and the opening in the liner.

2. The method of claim 1 further comprising the step of selectively moving the slide covering the side opening and the opening in the bag, thereby closing the box and the bag with one movement.

3. The method of claim 1 further comprising the step of removing a removable portion of the liner to form the opening in the liner.

4. The method of claim 1 further comprising the step of engaging a tab on the slide with a user's thumb when opening the box.

5. The method of claim 1 further comprising the step of moving the slide against at least one stop member limiting sliding movement of the slide.

6. The method of claim 3 further comprising the step of perforating the bag to create the removable portion.

7. The method of claim 1 further comprising the steps of folding the box blank and adhering a side edge of the liner to another side edge of the liner creating a sealed tube inside the box.

8. The method of claim 7 further comprising the step of sealing bottom edges of the liner forming a sealed bag inside the box.

9. The method of claim 1 further comprising the step of stacking a multiplicity of the boxes in a collapsed configuration for later use.

10. The method of claim 9 further comprising the step of opening the boxes from the collapsed configuration for filling with the pourable product.

11. A method of packaging pourable product comprising:

forming a box blank having a plurality of sides coupled together, a first side having a side opening and a retention portion coupled thereto, the retention portion being folded over to at least partially overlay a slide disposed against the first side to cover the side opening, the box blank being thereby partially folded;

providing a sheet of moisture impervious material;

attaching the sheet to the partially folded box blank to form a covered box blank, the sheet having a removable portion defining an opening overlaying the side opening, the slide being spaced from the sheet by the retention portion in the covered box blank;

folding the covered box blank, the sheet folding concurrently with the sides of the box blank along a plurality of fold lines defined between the sides to substantially form a sealed bag.

12. The method of claim 11 further comprising the step of selectively moving the slide, thereby uncovering the side opening and an opening in the bag.

13. The method of claim 11 further comprising the step of applying an adhesive to a predetermined portion of the sheet for attaching to another portion of the sheet for forming a sealed tube from which the sealed bag is formed.

14. The method of claim 11 further comprising the step of collapsing the box into a substantially tint configuration.

15. The method of claim 14 further comprising the step of stacking a multiplicity of boxes in the substantially flat configuration.

16. The method of claim 14 further comprising the step of opening the box from the substantially flat configuration and introducing pourable product therein.

17. A method of packaging and dispensing pourable product comprising:

forming a box blank having a plurality of sides coupled together, a first side having a retention portion coupled thereto, the retention portion being folded over to at least partially overlay a slide disposed against the first side to cover a side opening, the box blank being thereby partially folded;

attaching a liner of moisture impervious material to substantially cover the partially folded box blank to form a covered box blank, the liner having a removable portion defining an opening overlaying the side opening, the slide being spaced from the liner by the retention portion in the covered box blank;

forming the covered box blank into a box by folding, the liner folding concurrently with the sides of the box blank along a plurality of fold lines defined between the sides to substantially form a bag inside the box;

filling the bag with the pourable product;

selectively moving the slide uncovering the side opening and the opening in the liner, thereby opening the box and the bag with one movement; and dispensing the pourable product through the side opening and the opening in the liner.

* * * * *